US005224499A

United States Patent [19]

Zayas

[11] Patent Number: 5,224,499

[45] Date of Patent: Jul. 6, 1993

[54] POCKET ASHTRAY

[76] Inventor: Jesus A. Zayas, Avda. Reyes Catolicos No. 25, 6°, 3ª, E-38005 Santa Cruz de Tenerife, Spain

[21] Appl. No.: 720,462

[22] PCT Filed: Oct. 17, 1990

[86] PCT No.: PCT/ES90/00035

§ 371 Date: Aug. 13, 1991

§ 102(e) Date: Aug. 13, 1991

[87] PCT Pub. No.: WO91/05486

PCT Pub. Date: May 2, 1991

[30] Foreign Application Priority Data

Oct. 17, 1989 [ES] Spain ..... 8903060[U]

[51] Int. Cl.[5] ..... A24F 19/00; B65D 85/18

[52] U.S. Cl. ..... 131/231; 131/241; 131/242; 206/245; 206/246; 206/273; 206/299; 206/496

[58] Field of Search ..... 131/231, 241, 242; 206/491, 236, 245, 246, 273, 299, 496

[56] References Cited

U.S. PATENT DOCUMENTS 2,868,362 1/1959 McFaul .
2,966,293 12/1960 Goodsholl .
3,017,063 1/1962 Rooney .
3,372,724 3/1968 Rouse .

FOREIGN PATENT DOCUMENTS 2613449 10/1977 Fed. Rep. of Germany .
1231501 5/1971 United Kingdom .

*Primary Examiner*—V. Millin
*Assistant Examiner*—J. Doyle
*Attorney, Agent, or Firm*—Fitzpatrick, Cella, Harper & Scinto

[57] ABSTRACT

A portable or pocket ashtray made of a flexible, heat resistant material, which may be die-cut, forming a dihedral receptacle with an aperture for receiving refuse and a cover both to securely cover the receptacle when not in use and to act as a supporting leg for table top use when the cover is backfolded.

6 Claims, 4 Drawing Sheets

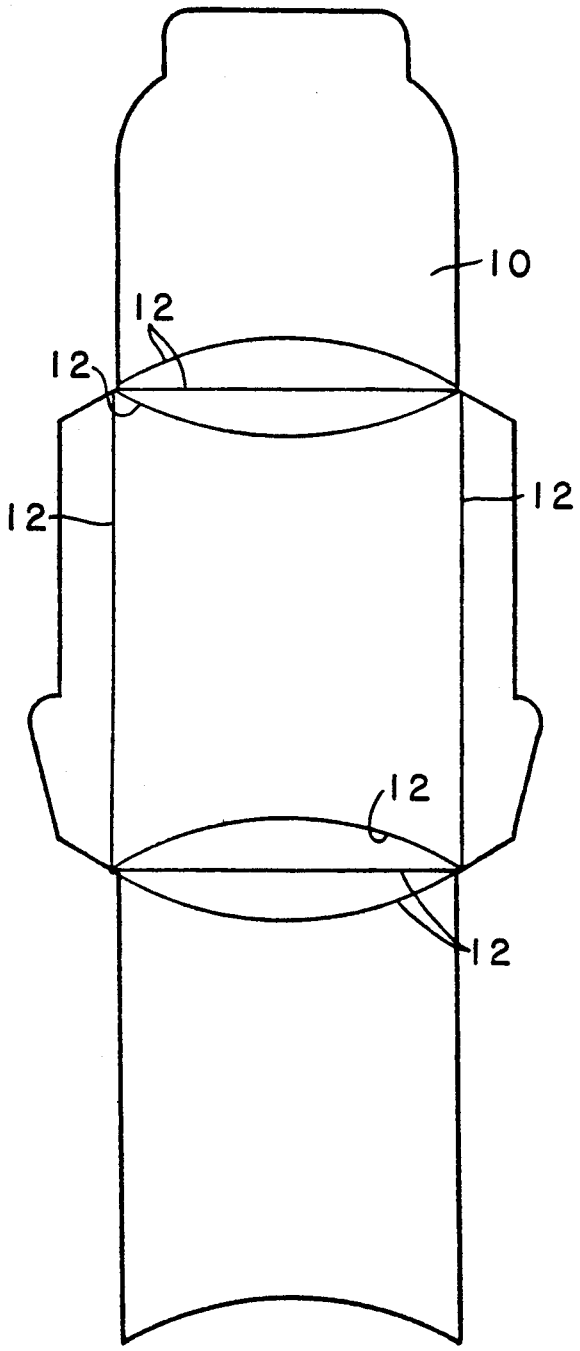
FIG. 1
FIG. 2
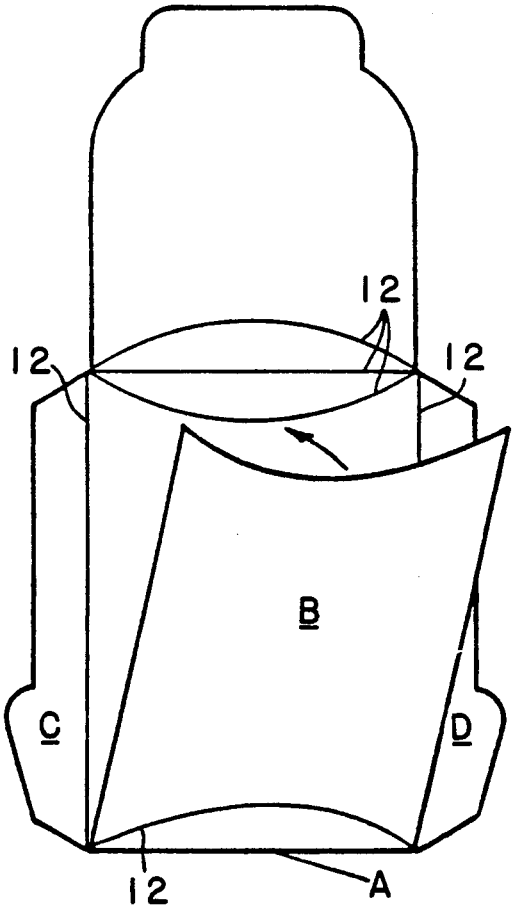

POCKET ASHTRAY

PURPOSE OF THE INVENTION

This invention, as its name indicates, refers to a folding, fireproof and disposable portable or pocket ashtray. Its features allow the smoker to use it under any circumstances, carrying it with him at all times, since its dimensions are small.

The purpose of the present invention is to store ashes and burning cigarette butts which are immediately put out when a protective cover is closed.

The present invention has been conceived to enable smokers to put out their cigarettes in the many circumstances which occur daily when they do not have an adequate place to do so, frequently giving way to compromising, unhygienic and even dangerous situations, as they could cause fires. We have also taken into consideration that all persons who consume a product are required to collect its leftovers, but smokers obviously cannot store them in their pockets.

For the above-stated reasons, through the habit of using a pocket ashtray, smokers could help change their bad image, conferring upon themselves an image of elegance and good manners. The ideal places for using them would be public areas, such as: commercial premises, stations and airports, beaches, swimming pools, hotels, meetings, cocktail bars, symposiums, sport arenas, etc.

Although its apparent usage is solely for smokers, it is indirectly beneficial to everyone's health and safety, and therefore a high degree of general acceptance of a portable or pocket ashtray can be expected.

SUMMARY OF THE INVENTION

It is an object of the present invention to provide such a portable or pocket ashtray.

In accordance with an aspect of the present invention, a portable or pocket ashtray comprises a flexible, heat-resistant material defined by its shape to provide a cover and lateral flaps extending from a back surface, the flaps being folded over and affixed to an outer front surface, wherein two protrusions are provided by unaffixed portions of the lateral flaps, to form a dihedral receptacle with an aperture for receiving refuse at one end and side edges formed at the juncture of the front and back surfaces adjacent to the aperture and extending to a closed end, wherein the cover may be folded and inserted under said unaffixed portions of said protrusions to close the aperture, and further comprises curved grooves in the material which allow the cover to be folded back extending to a table top surface and used as a supporting leg.

BRIEF DESCRIPTION OF THE DRAWINGS

FIG. 1 shows a die-cut, pre-grooved form of the invention, including grooves where folds may be made.

FIG. 2 shows the folds necessary to form one embodiment the invention.

DETAILED DESCRIPTION OF PREFERRED EMBODIMENTS

In view of the foregoing considerations, a portable or pocket ashtray has been developed in the initial form of a flat etui, of a size similar to that of a credit card of the smallest dimensions and with particular characteristics which allow it to be converted into a hand-carried receptacle. The ashtray acquires volume by pressing it at its base, with the added possibility of being able to be converted into a table ashtray and has a sufficiently airtight cover.

This invention is made of a flexible, laminated material which is resistant to lighted cigarettes, or with two or more laminae glued together, provided that the interior lamina which will be in contact with the lighted cigarette, is fireproof. In the case of the sample which we are going to describe below, the material selected is cardboard with a glued lamina, the latter being on the inside.

The outside can be printed in full color, by lithographic, serigraphic or other processes, to be used as a means of advertising, adding further attraction to the product.

For a better understanding of the significance of this invention, we are going to describe not only its shape, but also its use, taking advantage of the attached designs of the laminae, in which the preferred realization is shown, this being put forth only as a non-limitative example.

Starting with an adequate, laminated and preferably printed material, as previously described, taking into consideration the direction of the cardboard fibre to assure the correct function of the product, the material will be die-cut to the form 10 shown in FIG. 1, which also marks the grooves 12 where the various folds should be made, not only in the manufacturing process but also in its usage.

Figure 3:
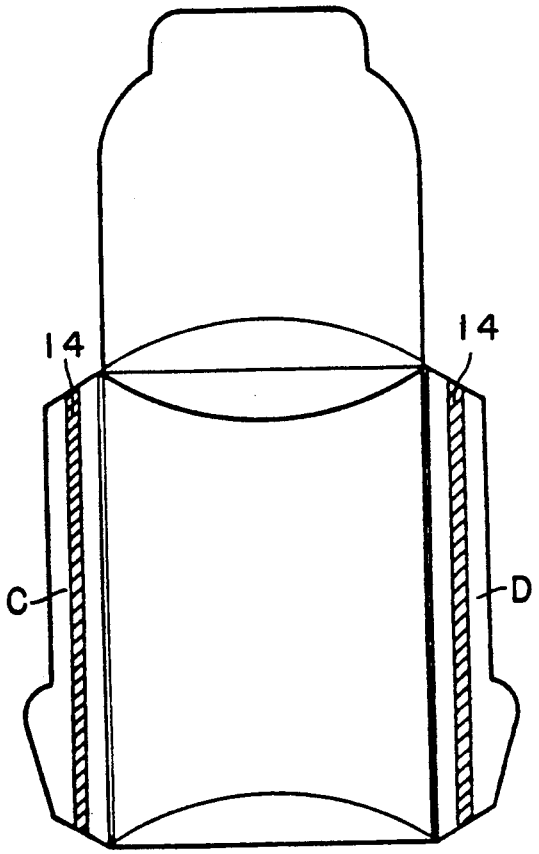
FIG. 3 shows the lateral flaps which affix the back to front surfaces thereby defining the shape of the invention.
Figure 4:
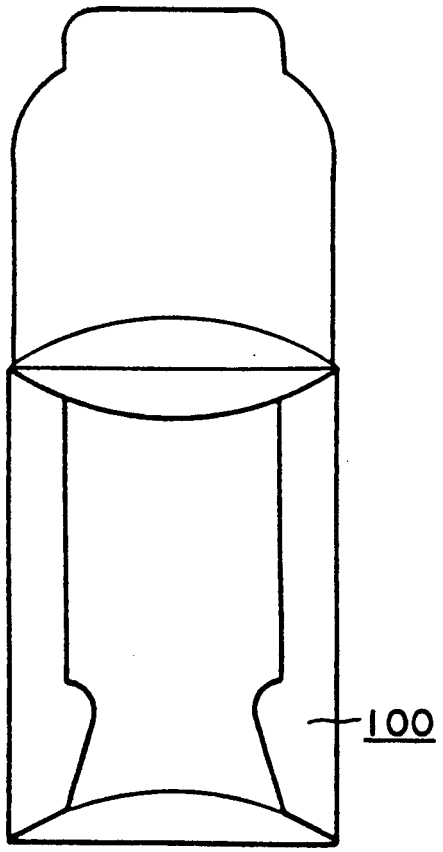
FIG. 4 shows the formed structure.

The finishing of the product begins with folding surface B 180° at groove A (FIG. 2), and after gluing flaps C and D at strips 14 (FIG. 3) so they adhere to the outside of surface B (FIG. 4) to form ashtray 100. In this process, protrusions E and F should be free of glue.

Figure 5A:
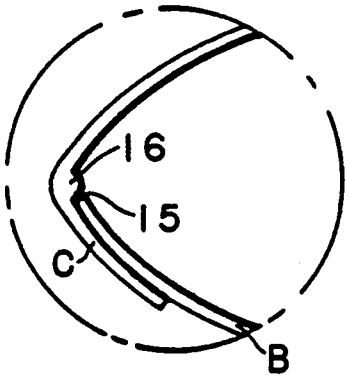
FIGS. 5A and 5B show the vertical mounds or beads which prevent formation of reliefs or edges on the inside of the formed cavity.
Figure 5B:
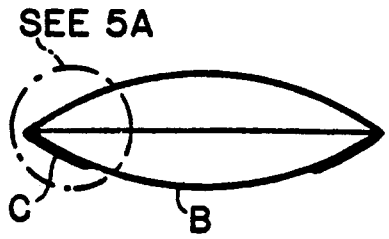

The importance of gluing flaps C and D on the outside lies in the fact that the inside of the ashtray 100 must remain entirely unobstructed and smooth, without any reliefs or edges, principally because the outside cover is not of a fireproof material and may otherwise catch fire. The edges 15 of the lateral sides of surface B are completely hidden by the vertical mounds or beads 16 of flaps C and D (FIG. 5).

Figure 6:
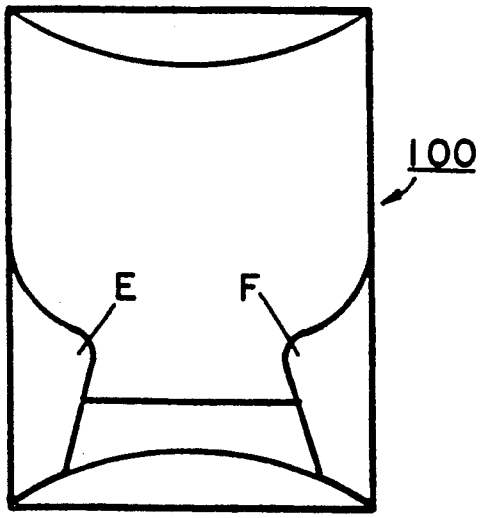
FIG. 6 shows an embodiment of the invention with the cover closed and secured within the rounded protrusions arising from affixed lateral flaps.

These flaps have two rounded protrusions, E and F, the purpose of which is to secure the protecting cover when it is closed (FIG. 6). With this operation, the ashtray is complete and ready for use.

Figure 7:
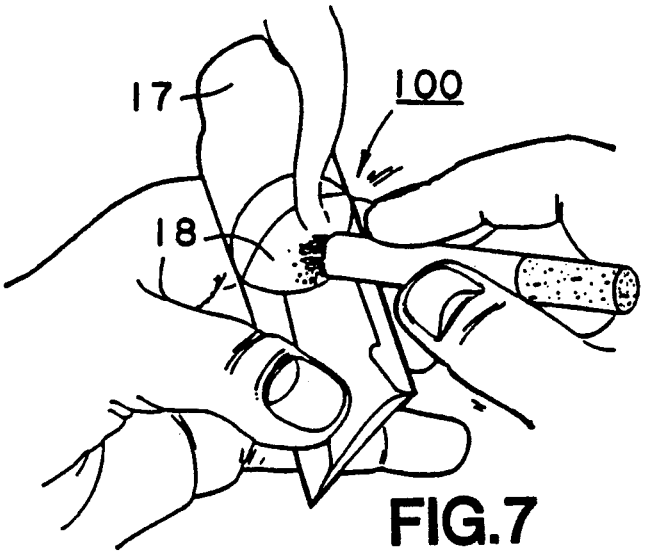
FIG. 7 shows the invention during hand held use.

The way to use the ashtray is very simple:

It is sufficient to open the cover 17 by 180° and apply pressure to the base. The latter then widens at the curved grooves to an adequate radius so that, when the pressure is released, an oval-formed cavity 18 remains, leaving the top of the ashtray open and ready for hand-carried use (FIG. 7).

Figure 8:
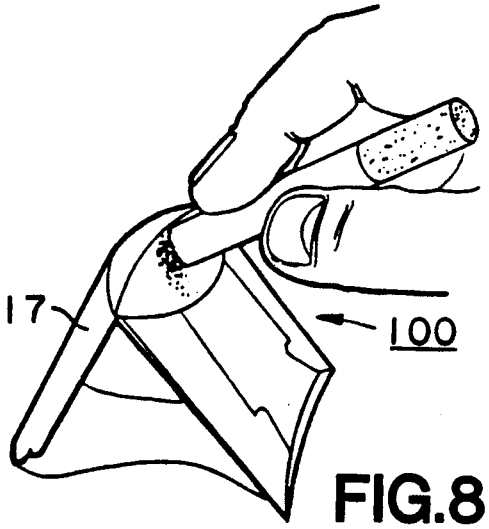
FIG. 8 shows the invention during table top use.

Another alternative for the invention that we are describing, is its use as a table-top ashtray. For this purpose, it is necessary to fold the cover 17 backwards at the curved groove, pressing both sides of the cover fold so that the top is completely open and the curved cover acts as a steady supporting leg (FIG. 8).

Figure 9:
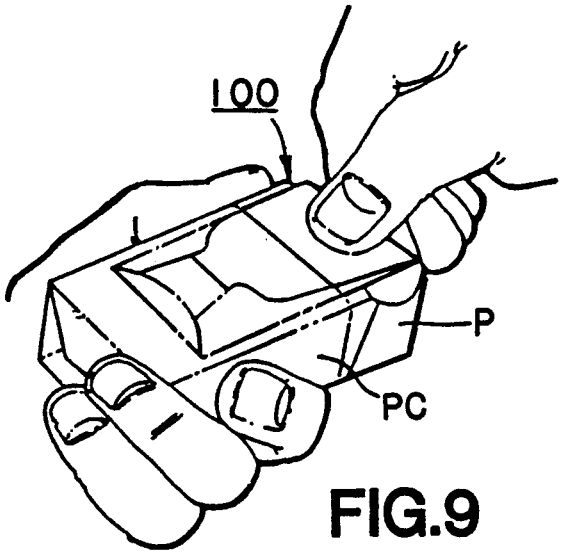
FIG. 9 shows the invention of the size for insertion in a package of cigarettes.

The above example describes an ashtray of a size appropriate enough to be carried in between a packet of cigarettes P and its cellophane cover PC (FIG. 9), can hold from eight to ten cigarette butts, which can be deposited inside when they are still lit, rapidly extinguishing themselves when the cover is closed. It has been calculated that the burning butt will be extinguished in less than 5 seconds, having consumed the little oxygen contained in the cavity.

The heat produced by the burning butt entering in contact with the interior surface is diffused by the aluminum lamina, which being a good conductor of heat, spreads it out over a wide area, thereby reducing the peak temperature. The outside cardboard surface acts at the same time as an insulator, radiating less than 50° C. to its carrier, and only during a few seconds.

Another quality factor which distinguishes this ashtray is its sufficiently airtight cover, which prevents ashes and strands of tobacco from falling out when stashed inside a pocket.

The curved contours at the top are not there for aesthetic reasons. On one hand, they allow for the use of a wider aperture. But, also, since the only way the ashtray can expand in its horizontal section is in a curved form, the studied profile of the cover adapts itself slowly and perfectly to that which the opening acquires as the content volume increases when filled with cigarette butts. Accordingly, the cover conforms to the changing shape thus preventing anything from falling out from inside, or the ashtray emptying itself unexpectedly inside one's pocket.

Another advantage of this invention is its hygienic usefulness. It does not produce the foul odors typical of conventional ashtrays, because the butts, as we have previously explained, are quickly extinguished, not causing the smell of overburnt cigarettes.

Once it is full, the ashtray can be emptied and cleaned for reuse, but owing to the fact that its price may be lower than that of a single cigarette, it becomes a product known as "disposable" or "one use only", so popular nowadays, for the added convenience of its user.

The material described in this example does not contaminate the environment, for which reason no rejection is expected from ecologists; rather, because of its public and hygienic utility it will be welcomed.

The ashtray described herein, as we have repeatedly stated, is of the so-called pocket type, being perfectly understood that it can be manufactured in larger sizes and capacities, for example, to be used preferably as a table-top ashtray.

Supports can also be included to rest cigarettes on while they are being smoked by making indents or cuts on the edge of the aperture. These indents and cuts can take the form of a horseshoe or otherwise, and are about the diameter of a cigarette or can be formed by supplemental material, folded and/or curved in the form of a channel, to hold the cigarette.

It is not deemed necessary to extend upon this description as any expert on the subject can perfectly understand the concept that we propose to patent and the advantages that can be derived from its industrial manufacture.

The materials, form, size and location of some of its components may be subject to alteration, as long as this does not imply a substantial change in the essence of the invention.

The terms used in this written description should always be construed in their most ample and unlimited meanings.

I claim:

1. A portable ashtray comprising a flexible, heat-resistant, laminated material defined by its shape to provide a cover, a front surface and a back surface having lateral flaps extending therefrom, said flaps being folded over and affixed to said front surface to form a dihedral receptacle with an aperture for receiving refuse at one end and side edges formed at the juncture of said front and back surfaces adjacent to said aperture and extending to a closed end, wherein:

said material is die-cut as one piece and comprises cardboard which is foil coated on one side, said material being folded to form said receptacle with said cardboard on the outside of said receptacle, two protrusions are provided by unaffixed portions of said lateral flaps and said cover may be folded and inserted under said unaffixed portions to close said aperture, curved contours in said material enable said receptacle to provide a cavity that is expandable to accommodate increasing refuse volume, beads formed along fold lines of said front and back surfaces abut internal edges of said material, and curved grooves in said material allow the cover to be folded back for extending to a table top surface and used as a supporting leg.

2. A portable or pocket ashtray according to claim 1, wherein said receptacle is impervious to spills or leakage when said aperture is closed by said cover.

3. A portable or pocket ashtray according to claim 1, wherein said receptacle is substantially airtight so as to extinguish cigarettes placed therein when said aperture is closed by said cover.

4. A portable or pocket ashtray according to claim 1, wherein semicircular cuts or indents in said material at said aperture edge forms a channel for holding a cigarette.

5. A portable or pocket ashtray according to claim 1, wherein said cover is of sufficient length to support said receptacle in an upright position.

6. A portable or pocket ashtray according to claim 1, wherein said receptacle is of a size that fits within a pocket or cigarette package.

* * * * *